United States Patent [19]

Elenbaas

[11] Patent Number: 4,642,593

[45] Date of Patent: Feb. 10, 1987

[54] IMPULSE MERCURY RELAY WITH MAGNETIC INTERLOCK SWITCH

[76] Inventor: George H. Elenbaas, 25526 N. Shore Dr., Elkhart, Ind. 46514

[21] Appl. No.: 601,301

[22] Filed: Apr. 17, 1984

[51] Int. Cl.[4] ..... H01H 29/16

[52] U.S. Cl. ..... 335/52; 335/151; 335/153

[58] Field of Search ..... 335/47, 49, 51, 52, 335/79, 151, 152, 153

[56] References Cited

U.S. PATENT DOCUMENTS

| | | | |
|---|---|---|---|
| 1,935,710 | 11/1933 | Hatay | 335/50 |
| 2,302,537 | 11/1942 | Ellwood | 335/63 |
| 2,303,548 | 12/1942 | Hedin | 335/51 |
| 2,474,000 | 6/1949 | Keating | 335/50 |
| 2,506,763 | 5/1950 | Babler | 335/50 |
| 2,508,508 | 5/1950 | Garvin | 335/51 X |
| 2,658,124 | 11/1953 | Weimer | 335/49 |
| 2,709,738 | 5/1955 | Walter | 335/53 |
| 2,838,721 | 6/1958 | Mitchell | 335/299 |
| 2,914,633 | 11/1959 | Houser | 335/51 |
| 2,959,650 | 11/1960 | Hajny | 335/51 X |
| 2,978,588 | 4/1961 | Mitchell | 250/215 |
| 3,037,103 | 5/1962 | Binford | 335/58 |
| 3,128,358 | 4/1964 | Mitchell | 335/52 |
| 3,133,998 | 4/1964 | Horowitz | 335/52 |
| 3,141,940 | 7/1964 | Horowitz | 335/52 |
| 3,142,736 | 7/1964 | Mitchell | 335/52 |
| 3,166,654 | 1/1965 | Mitchell | 335/52 |
| 3,177,410 | 4/1965 | Pressman | 361/184 |
| 3,187,142 | 6/1965 | Elenbaas | 335/53 |
| 3,198,911 | 8/1965 | Mitchell | 335/52 |
| 3,281,604 | 10/1966 | Horowitz | 250/225 |
| 3,304,380 | 2/1967 | Mitchell | 200/43.08 |
| 3,335,331 | 8/1967 | Pressman | 361/173 |
| 3,339,126 | 8/1967 | Horowitz | 204/180.2 |
| 3,356,908 | 12/1967 | Mitchell | 361/173 |
| 3,363,205 | 1/1968 | Beck | 335/52 |
| 3,381,248 | 4/1968 | Furth | 335/51 |
| 3,487,358 | 12/1969 | Ubukata | 335/51 X |
| 3,569,877 | 3/1971 | Robbins | 335/52 X |
| 3,673,524 | 6/1972 | Lowry | 335/52 |
| 4,292,615 | 9/1981 | Ohashi | 335/205 |
| 4,366,458 | 12/1982 | Elenbaas | 335/52 |

*Primary Examiner*—George Harris

*Attorney, Agent, or Firm*—Jeffers, Irish & Hoffman

[57] ABSTRACT

An impulse mercury relay with magnetic interlock switch is provided comprising a first electrode member containing a body of a liquid conductor therein, a second electrode member received and secured inthe first electrode member, and a displacement plunger movable in the first electrode member to cause contact between the liquid conductor and second electrode member. A magnet device is movable with the displacement plunger, and a magnetically-actuable switch externally disposed of the first electrode member is actuated by the magnet when moved with the displacement plunger. A holding device is also provided to magnetically hold the displacement plunger at the desired position when the coil device is deenergized.

41 Claims, 7 Drawing Figures

IMPULSE MERCURY RELAY WITH MAGNETIC INTERLOCK SWITCH

BACKGROUND OF THE INVENTION

This invention pertains to mercury displacement relays, and more particularly to an impulse mercury relay with magnetic interlock switch for use in electrical circuits, especially for circuits requiring interlock relays actuable by an electrical impulse of relatively short duration.

It is well known to those familiar with electrical circuits that often an electrical interlock switch is needed to protect or ensure proper functioning of electrical machines and equipment. For example, with electrically-operated mining machinery, the operator should be prevented from simultaneously switching the machinery into both forward and reverse positions to avoid damaging the machinery. This can be accomplished if a normally-closed switch in the forward gear contactor is wired into the reverse gear contactor. Moreover, if it is desired, a time delay element can be added to the interlock switch to establish a period of time which must elapse before switching or shifting between forward and reverse gear contactors.

Although interlock switches, such as described above, have been satisfactorily used in electro-mechanical devices, they have generally not been satisfactorily designed for use in mercury displacement relays in electrical circuits.

Further, it can be desirable to operate an electrical relay with an impulse, i.e., a coil actuation of short duration, after which the electrical contacts remain closed by a latching mechanism. Generally, this mechanism is mechanically employed in electro-mechanical relays and mercury displacement relays. One of the problems with prior art mechanical latching mechanisms in mercury displacement relays is that some of the mechanical latching elements can be exposed to the intense arcing environment in the electrode above the mercury level, and therefore prematurely fail because of erosion and heat damage caused by the arcing.

SUMMARY OF THE INVENTION

The present invention provides a unique solution to the need of an interlock switch and latching mechanism in mercury displacement relays.

Typically, a mercury displacement relay generally comprises a cylindrical electrode containing a body of mercury, a pin electrode sealed within the cylindrical electrode and insulated therefrom, a displacement plunger within the cylindrical electrode, and a coil device in proximity to the cylindrical electrode for moving the displacement plunger between a first position wherein the mercury and pin electrode are in spaced-apart relation and a second position wherein the displacement plunger is displaced downwardly in the mercury when the coil device is energized to thereby displace the mercury upwardly in electrical contact with the pin electrode. Such mercury displacement relays can be either of the normally-closed type wherein the mercury and pin electrode are in electrical contact when the displacement plunger is at the first position and the coil device deenergized, and a normally-open type wherein the mercury and pin electrode are in spaced-apart relation when the plunger is at the first position and the coil device deenergized.

The present invention provides in conjunction with a mercury displacement relay a magnet attached to the bottom of the displacement plunger and a magnetically-actuable switch externally disposed of and adjacent to the bottom of the cylindrical electrode. The switch can be either a normally-open or normally-closed type, or a single pole double throw type, and is actuated when the coil device is energized to move the displacement plunger from a first position to a second position wherein the mercury level rises to make electrical contact with the pin electrode and the magnet actuates the switch. If the switch is a normally-open switch, it will be closed by the magnet when the displacement plunger is at the second position, and if the switch is a normally-closed switch, it will be opened by the magnet when the displacement plunger is at the second position. Upon deenergizing the coil device, the displacement plunger buoyantly moves from the second position to the first position causing the mercury level to recede to break contact with the pin electrode and to deactuate the switch.

The present invention also contemplates attaching the magnet to the top of the displacement plunger and positioning the magnetically-actuable switch near the top of the cylindrical electrode so that the switch is actuated when the displacement plunger is at the first position and the mercury and pin electrode are in spaced-apart relation. Again, the switch may be either a normally-open, a normally-closed, or a single pole double throw switch, and upon energizing the coil device, the displacement plunger moves from the first position to the second position causing the mercury level to rise and contact the pin electrode and to deactuate the switch. Naturally, the magnet has a magnetic field strength sufficient to actuate and deactuate the switch. For example, when the magnet is on the bottom of the displacement plunger and the magnetically-actuable switch is adjacent the bottom of the cylindrical electrode, the magnetic field of the magnet will only actuate the switch when the magnet and displacement plunger are at the second position; whereas at the first position, the magnet does not actuate the switch. Similarly, with the magnet on top of the displacement plunger and the switch near the top of the cylindrical electrode, the switch is magnetically actuated only when the magnet and displacement plunger are at the first position. The switch can be either magnetically held in the open position or closed position when the magnet and displacement plunger are at the first position to thereby provide either an open or closed switch, respectively.

The present invention further provides a magnetic latching device in a mercury displacement relay wherein a magnet is attached to the bottom of the displacement plunger and a ferromagnetic material is externally secured to the bottom of the cylindrical electrode. When the displacement plunger is then moved from the first position to the second position upon energizing the coil device, the magnet is positioned sufficiently close to the ferromagnetic material to magnetically hold the displacement plunger at the second position when the coil device is deenergized. Thus, only a momentary actuation of the coil device is required to displace and hold the plunger at the second position to maintain electric contact between the mercury and pin electrode. To separate the magnet from the ferromagnetic material, a second coil device is provided in proximity to the cylindrical electrode, and upon being energized, the second coil device overcomes the magnetic attraction between the magnet and ferromagnetic material to thereby allow the displacement plunger to move from the second position to the first position with the first coil device deenergized.

An alternate means for separating the magnet from the ferromagnetic material includes providing a permanent magnet device in proximity to the cylindrical electrode and which can be manually moved near to the displacement plunger to overcome the magnetic attraction between the plunger magnet and ferromagnetic material, thereby allowing the displacement plunger to return to the first position from the second position.

Additionally, if it is desired, the magnet can be attached to the top of the displacement plunger and the ferromagnetic material externally secured to the top portion of the cylindrical electrode to magnetically hold the displacement plunger at the first position.

In one form of the invention there is provided a liquid conductor relay comprising a cylindrical electrode having a top portion and a bottom portion, a liquid conductor contained in the cylindrical electrode, and a pin electrode received and secured in the cylindrical electrode. A displacement plunger is disposed in the cylindrical electrode and is movable between a first position wherein the liquid conductor and pin electrode are in spaced-apart relation and a second position wherein the displacement plunger is displaced downwardly in the liquid conductor to displace the liquid conductor upwardly in contact with the pin electrode, and a coil device is in proximity to the cylindrical electrode for moving the displacement plunger from the first position to the second position when energized. A magnet is movable with the displacement plunger between the first and second positions, and a magnetically-actuable switch is externally disposed of the cylindrical electrode and in close proximity thereto, whereby when the coil device is energized to move the displacement plunger and magnet from the first position to the second position the magnetically-actuable switch is actuated by the magnet and the liquid conductor is in contact with the pin electrode.

Another form of the present invention includes a liquid conductor relay comprising a cylindrical electrode having a top portion and a bottom portion, a liquid conductor contained in the cylindrical electrode, and a pin electrode received and secured in the cylindrical electrode. A displacement plunger is provided in the cylindrical electrode and is movable between a first position wherein the liquid conductor and pin electrode are in spaced-apart relation and a second position wherein the displacement plunger is displaced downwardly in the liquid conductor to displace the liquid conductor upwardly in contact with the pin electrode, and a coil device in proximity to the cylindrical electrode for moving the displacement plunger from the first position to the second position when energized. A magnet is disposed on the bottom portion of the displacement plunger and is movable therewith between the first and second positions, and a ferromagnetic material is externally secured to the bottom portion of the cylindrical electrode; the magnetic attraction between the magnet and ferromagnetic holding material being sufficient to hold the displacement plunger at the second position when the coil device is deenergized, thereby maintaining electrical contact between the liquid conductor and pin electrode.

Yet another form of the present invention includes a liquid conductor relay comprising a cylindrical electrode having a top portion and a bottom portion, a liquid conductor contained in the cylindrical electrode, and a pin electrode received and secured in the cylindrical electrode. A displacement plunger is disposed within the cylindrical electrode and movable between a first position wherein the liquid conductor and pin electrode are in spaced-apart relation and a second position wherein the displacement plunger is displaced downwardly in the liquid conductor to displace the liquid conductor upwardly in contact with the pin electrode, and a first coil in proximity to the cylindrical electrode for moving the displacement plunger from the first position to the second position when energized. A magnet is externally disposed of and adjacent to the bottom portion of the cylindrical electrode; the magnet magnetically holding the displacement plunger at the second position when the first coil device is deenergized, and a magnetically-actuable switch is externally disposed of the cylindrical electrode and in close proximity to the magnet wherein the switch is actuated by the magnet when the displacement plunger is at the first position. A second coil device is provided in proximity to the cylindrical electrode for overcoming the magnetic attraction between the magnet and displacement plunger at the second position to allow the displacement plunger to move from the second position to the first position when the second coil is energized. The displacement plunger is made of a material having sufficiently low permeance to substantially decrease the magnetic field strength of the magnet when at the second position to thereby deactuate the switch.

It is an object of the present invention to provide a mercury displacement relay with magnetic interlock switch wherein the switch is externally disposed of the relay and magnetically-actuable by a magnet attached to the displacement plunger in the relay.

Another object of the present invention is to provide a mercury displacement relay with magnetic interlock switch including a plurality of such switches magnetically actuable by one or more magnets attached to the displacement plunger in the relay.

A further object of the present invention is to provide a mercury displacement relay with a latching device that magnetically holds the displacement plunger at a desired position when the coil is deenergized.

A still further object of the present invention is to provide an impulse mercury relay with magnetic interlock switch wherein a latching device magnetically holds the displacement plunger at a desired position when the coil is deenergized and a magnet movable with the displacement plunger actuates a magnetically-actuable switch externally disposed of the relay.

Further objects of the present invention will appear as the description proceeds.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DETAILED DESCRIPTION

Figure 1:
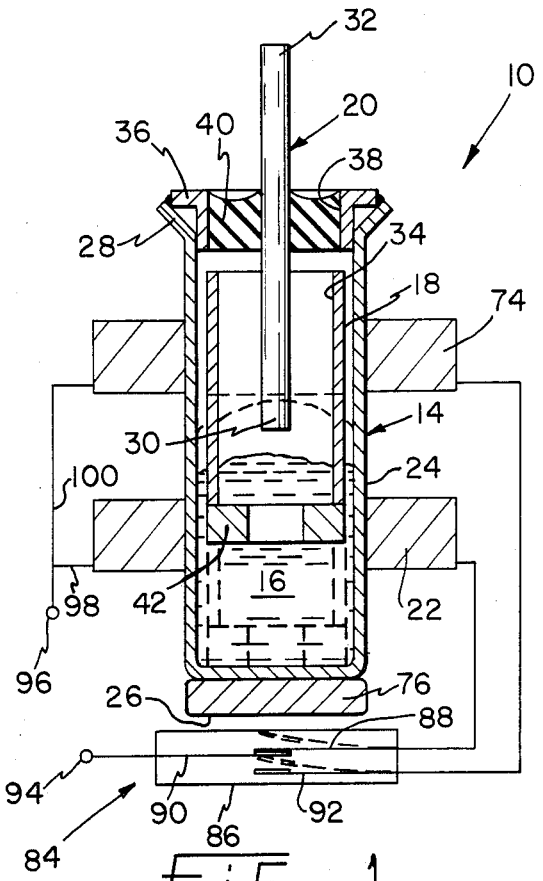
FIG. 1 is an elevational view in section of one form of the present invention.

Impulse mercury relay with magnetic interlock switch 10 in FIG. 1 illustrates one embodiment of the present invention and will be described in greater detail hereinafter. However, for purposes of clarity and understanding, modifications of relay 10 will be described initially beginning with FIGS. 4, 5 and 6.

Figure 4:
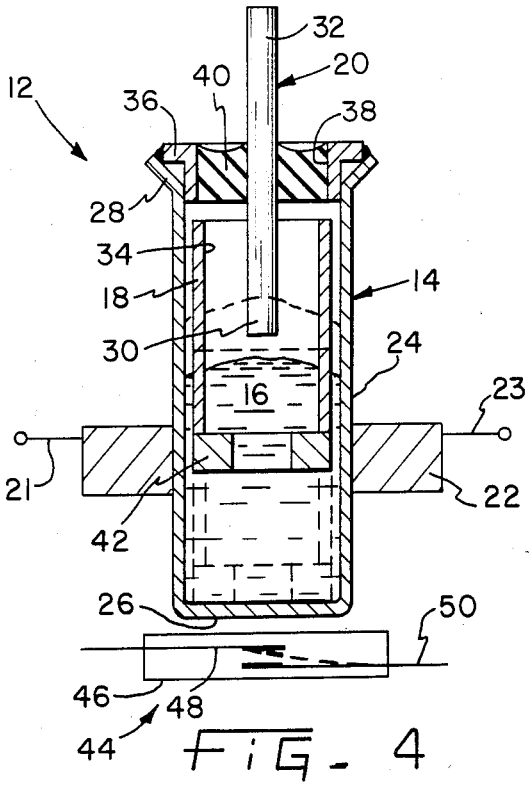
FIG. 4 is an elevational view in section of a third modification of the embodiment in FIG. 1.

Referring now to FIG. 4, there is illustrated mercury relay 12 comprising cylindrical electrode 14 made of a non-magnetic stainless steel or other suitable material, mercury body 16 contained within cylindrical electrode 14, displacement plunger 18 made of a ferromagnetic or similar material and movably disposed within cylindrical electrode 14, pin electrode 20, and coil device 22 which creates an electromagnetic field within cylindrical electrode 14 when energized. Coil device 22 is energized when current is supplied through lines 21,23 electrically connected to device 22. Cylindrical electrode 14 further comprises continuous wall 24, bottom wall 26, and shoulder 28 formed from continuous wall 24. Cylindrical electrode 14 is partially filled with mercury body 16. Displacement plunger 18 may also include a ceramic liner and plunger guide flanges (not shown), and may be attached to cylindrical electrode 14 as more clearly described in U.S. Pat. No. 4,366,458 issued Dec. 28, 1982 to the present applicant. U.S. Pat. No. 4,366,458 being incorporated by reference herein.

Pin electrode 20 has bottom end 30 and top end 32 and is received within cylindrical electrode 14 and opening 34 of displacement plunger 18. Cap 36, which has opening 38 disposed therethrough, is placed within and resistance welded to shoulder 28 of cylindrical electrode 14, and has pin electrode 20 received through opening 38 and secured therein by glass insulation 40 between pin electrode 20 and cap 36.

Coil device 22 is positioned about cylindrical electrode 14 so that during its deenergized period displacement plunger 18 is positioned within cylindrical electrode 14 as illustrated in solid lines. In this first position, mercury body 16 and pin electrode 20 are in spaced-apart relation. When coil device 22 is energized, displacement plunger 18 is moved downwardly into mercury body 16 as illustrated in dashed lines, thereby causing mercury body 16 to rise upwardly as illustrated in dashed lines in contact with bottom end 30 of pin electrode 20 to complete the electrical circuit between pin electrode 20 and cylindrical electrode 14.

Permanent ring magnet 42 is attached in any suitable manner to the bottom end portion of displacement plunger 18, and magnetically-actuable reed switch 44 is externally disposed and adjacent to bottom wall 26 of cylindrical electrode 14. Reed switch 44 comprises an enclosure 46 housing two electrically conductive reed members 48, 50 which are in spaced-apart relation when displacement plunger 18 and magnet 42 are at their first position. Reed member 48 is substantially rigid and reed member 50, which is disposed below reed member 48 relative to bottom wall 26, is resilient so as to be deflectable upwardly into electrical contact with reed member 48.

In the operation of mercury relay 12, when coil device 22 is deenergized, displacement plunger 18 and magnet 42 are positioned as illustrated in solid lines in FIG. 4, mercury body 16 is in spaced-apart relation to pin electrode 20, and reed members 48, 50 are likewise in spaced-apart relation. Upon energizing coil device 22, the electromagnetic field created thereby moves displacement plunger 18 and magnet 42 from their first position illustrated in solid lines to a second position illustrated in dashed lines causing the level of mercury body 16 to be displaced upwardly as illustrated in dashed lines in electrical contact with pin electrode 20, and magnetically deflecting resilient reed member 50 upwardly into electrical contact with reed member 48. When coil device 22 is deenergized, displacement plunger 18 and magnet 42 return to their first position, thereby causing mercury body 16 to recede and break electrical contact with pin electrode 20 and reed member 50 to resiliently return to its spaced-apart position relative to reed member 48.

The present invention as embodied in mercury relay 12 also contemplates reed switch 44 being a normally-closed switch wherein reed members 48, 50 are in electrical contact when displacement plunger 18 and magnet 42 are at the first position. As a normally-closed switch, reed member 50 is rigid and reed member 48 is resilient. Upon energization of coil device 22, displacement plunger 18 and magnet 42 move to the second position, wherein reed member 48 is magnetically and resiliently held in spaced-apart relation from reed member 50.

Figure 5:
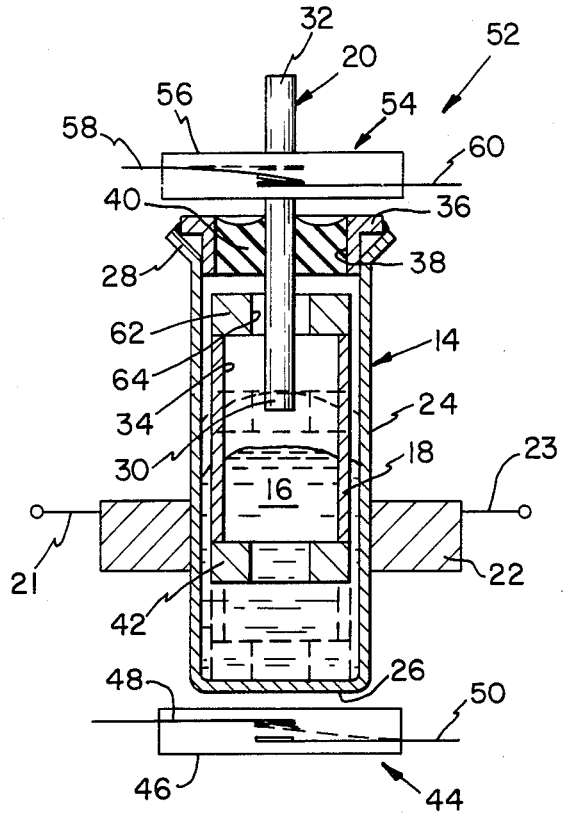
FIG. 5 is an elevational view in section of a fourth modification of the embodiment in FIG. 1.

Referring now to FIG. 5, mercury relay 52 is illustrated and is similar to mercury relay 12 and further includes a second magnetically-actuable reed switch 54 comprising enclosure 56 housing reed members 58, 60. Permanent ring magnet 62 is attached in any suitable manner to the top portion of displacement plunger 18 and has an opening 64 disposed therethrough for receiving pin electrode 20. Reed switch 54 is externally disposed and adjacent to the top portion of cylindrical electrode 14 and cap 36.

In operation of mercury relay 52, reed switch 44 can be either a normally-open or a normally-closed switch as described above, and reed switch 54 can be either a normally-open or a normally-closed switch. For example, when operating as a normally-open switch, reed member 58 is substantially rigid and assumes the position indicated in dashed lines and reed member 60 is magnetically and resiliently held in spaced-apart relation from reed member 58 when displacement plunger 18 and magnet 62 are at the first or uppermost position. Upon energizing coil device 22 to move displacement plunger 18 and magnets 42, 62 to the second or lowermost position indicated in dashed lines, reed member 60 resiliently moves upwardly into electrical contact with reed member 58.

It should be clear that mercury relay 52 can be of four different types, i.e., both switches 44 and 54 can be normally-open switches, or both switches 44, 54 can be normally-closed switches, or switch 44 can be normally-open and switch 54 can be normally-closed, or switch 44 can be normally-closed and switch 54 can be normally-open.

In describing the operation of the present invention, the use of the terms "actuate", "deactuate", "actuating", and "deactuating" depends upon whether the switches 44, 54 are normally-open or normally-closed. In other words, if reed switch 54 is normally-open when displacement plunger 18 and magnet 62 are at the first position, then reed switch 54 is actuated when reed member 60 resiliently moves upwardly into electrical contact with reed switch 58 upon downward displacement of plunger 18 and magnets 42, 62. Similarly, if reed switch 54 is normally-closed by reed member 58 being magnetically and resiliently held in electrical contact with reed member 60 when plunger 18 and magnet 62 are at the first or uppermost position, then actuation of switch 54 occurs when displacement plunger 18 and magnets 42, 62 are moved downwardly upon energization of coil device 22 to thereby allow reed member 58 to move resiliently upwardly in spaced-apart relation from reed member 60 as indicated in dashed lines. Regarding switch 44, the use of the four above-quoted terms imply the same meaning, i.e., if switch 44 is normally-open with displacement plunger 18 and magnet 42 at the first position, then actuation of switch 44 occurs when coil device 22 is energized to move plunger 18 and magnet 42 to the second or lowermost position indicated in dashed lines, thereby magnetically and resiliently moving reed member 50 into electrical contact with reed member 48. If switch 44 is normally-closed, then actuation thereof occurs when plunger 18 and magnet 42 are in the second position to thereby magnetically and resiliently hold reed member 48 in spaced-apart relation from reed member 50.

Figure 6:
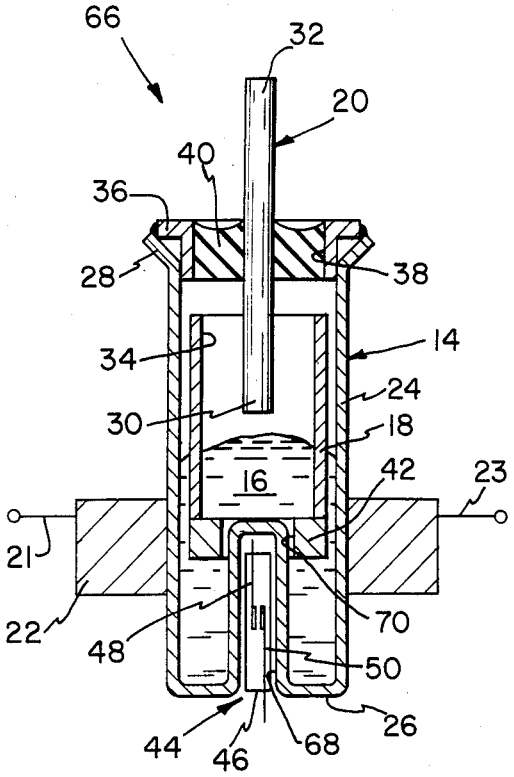
FIG. 6 is an elevational view in section of a fifth modification of the embodiment in FIG. 1.

Referring now to FIG. 6, mercury relay 66 is virtually identical to mercury relay 12 but includes slotted opening 68 disposed in bottom wall 26 of cylindrical electrode 14. Reed switch 44 is disposed within slotted opening 68 and magnet 42 includes opening 70 to permit magnet 42 to move relative to slotted opening 68. The operation of mercury relay 66 is similar to mercury relay 12 and mercury relay 52 in that switch 44 may be normally-open when plunger 18 and magnet 42 are at the first or uppermost position, or normally-closed when plunger 18 and magnet 42 are at the first position. Upon energizing coil device 22 in the first instance either one or both reed members 48, 50 may be magnetically and resiliently moved into electrical contact, and in the second instance reed members 48, 50 are magnetically and resiliently held in spaced-apart relation when plunger 18 and magnet 42 are at the second position.

Although displacement plunger 18 has been described as having either or both magnets 42,62 attached to its top and bottom portions respectively, the present invention includes displacement plunger 18 being made of a ferro-ceramic magnetic material, thereby acting as its own magnet and dispensing with ring magnets 42,62.

Figure 2:
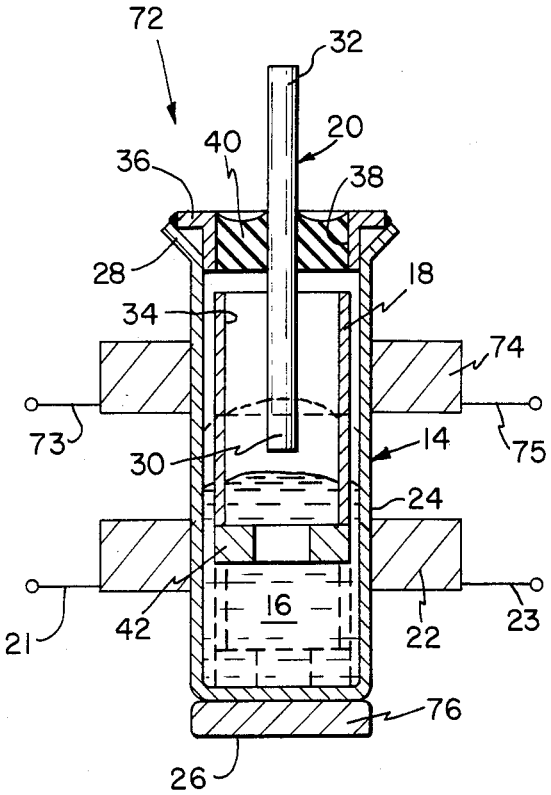
FIG. 2 is an elevational view in section of a modification of the embodiment in FIG. 1.

Referring now to FIG. 2, mercury relay 72 of the present invention is illustrated and is similar to mercury relay 12, but excludes reed switch 44 and includes coil device 74 disposed in proximity to cylindrical electrode 14 and between coil device 22 and shoulder 28 and a ferromagnetic member 76 externally secured to cylindrical electrode 14 on bottom wall 26. Ferromagnetic member 76 can be iron or any other suitable alloy, and coil device 74 is energized when electrical current is supplied to lines 73,75 electrically connected thereto.

In operation, with both coil devices 22,74. deenergized, displacement plunger 18 and magnet 42 are at their first position indicated in solid lines, and upon energizing coil device 22 displacement plunger 18 and magnet 42 are drawn downwardly into mercury body 16 as indicated in dashed lines. It should be noted that coil device 22 needs only to be energized for a short duration sufficient to move displacement plunger 18 and magnet 42 downwardly to the second position, at which time coil device 22 can be deenergized and displacement plunger 18 and magnet 42 will be magnetically held at the second position by the magnetic attraction between magnet 42 and ferromagnetic member 76. Thus, with coil device 22 deenergized, displacement plunger 18 is held at the second position to thereby maintain mercury body 16 in electrical contact with pin electrode 20. To break contact between mercury body 16 and pin electrode 20, coil device 74 is energized to create an electromagnetic field about the cylindrical electrode 14 sufficient to overcome the magnetic attraction between magnet 42 and ferromagnetic member 76, thereby separating magnet 42 from ferromagnetic member 76 to allow displacement plunger 18 to buoyantly move to the first position.

Figure 3:
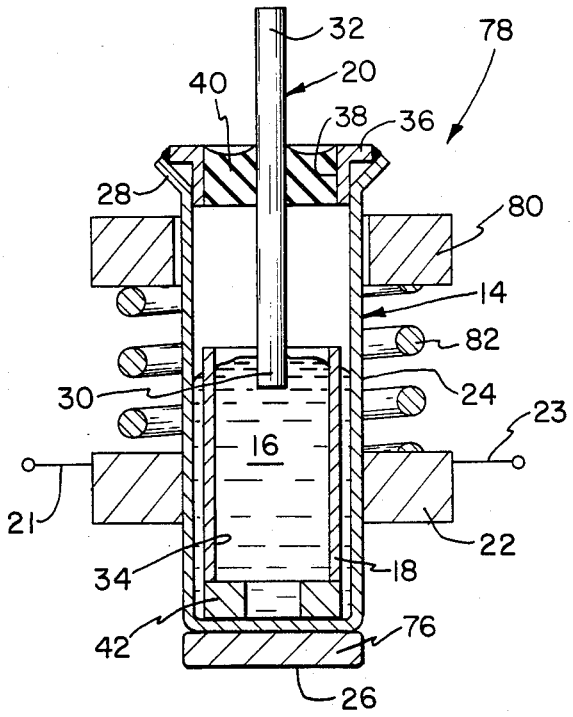
FIG. 3 is an elevational view in section of a second modification of the embodiment in FIG. 1.

Referring now to FIG. 3, mercury relay 78 is similar to mercury relay 72, but excludes coil device 74 and in place thereof includes permanent magnet 80 externally disposed about cylindrical electrode 14 and between coil device 22 and shoulder 28. A spring 82 is connected between coil device 22 and permanent magnet 80 to bias magnet 80 upwardly as indicated in FIG. 3.

The operation of mercury relay 78 is similar to that of mercury relay 72, except that the magnetic attraction between magnet 42 and ferromagnetic member 76 is overcome by manually moving permanent magnet 80 downwardly towards plunger 34 to separate magnet 42 from ferromagnetic member 76. Naturally, the magnetic attraction between permanent magnet 80 and plunger 34 is greater than the magnetic attraction between magnet 42 and ferromagnetic member 76.

Referring now to FIG. 1, impulse mercury relay with magnetic interlock switch 10 is illustrated with magnet 42 disposed on the bottom portion of cylindrical electrode 14, ferromagnetic member 76 externally secured to the bottom of cylindrical electrode 14, coil devices 22,74 in proximity to cylindrical electrode 14, and magnetically-actuable reed switch 84 externally disposed adjacently to bottom wall 26. Reed switch 84 is a single-pole double-throw switch comprising enclosure 86 housing reed members 88,90 and 92. Reed member 90 is adapted to be connected to a source of electrical energy (not shown), reed member 88 is electrically connected to coil device 22, and reed member 92 is electrically connected to coil device 74. With displacement plunger 18 at its first position indicated in solid lines in FIG. 1, reed members 88 and 90 are in electrical contact with each other, and reed member 92 is in spaced-apart relation from reed member 90. Upon applying voltage across terminals 94,96, to which are respectively connected reed member 90 and coil devices 22,74 by respective lines 98,100, electric current is supplied from reed member 90 to reed member 88 to energize coil device 22. Upon energizing coil device 22, displacement plunger 18 and magnet 42 move downwardly to their second position indicated in dashed lines where magnet 42 is magnetically held by ferromagnetic member 76 at the second position when coil device 22 is deenergized by terminating the flow of current through reed member 90, and mercury body 16 contacts pin electrode 20. Upon magnet 42 being held at its second position by ferromagnetic member 76, reed switch 88 is magnetically and resiliently moved in spaced-apart relation from reed member 90, which is rigid, and reed member 92 is magnetically and resiliently held in electrical contact against reed member 90. Thereafter, upon applying voltage to terminals 94,96, current is supplied through reed member 90 and reed member 92 to energize coil device 74 to create an electromagnetic field to overcome the magnetic attraction between magnet 42 and ferromagnetic member 76, thereby allowing displacement plunger 18 and magnet 42 to move from their second position to their first position. When magnet 42 moves away from ferromagnetic member 76, reed members 88,90 and 92 return to their original positions, and mercury body 16 recedes to break electrical contact with pin electrode 20.

Referring now to FIGS. 1–6, the present invention contemplates mercury relay 10 being modified to include other features of mercury relays 12,52,66,72 and 78. For example, mercury relay 10 can be modified to replace reed switch 84 with a switch similar to reed switch 44 having only two reed members 48,50. Reed switch 44 can then be either a normally-closed or a normally-open switch and can be actuated by applying an impulse to coil device 22 of short duration sufficient to move displacement plunger 18 and magnet 42 to the second position, whereat magnet 42 is magnetically held by the magnet attraction between magnet 42 and ferromagnetic member 76 when coil device 22 is deenergized. As earlier described above, switch 44 can be deactuated by energizing coil device 74. In this modification of mercury relay 10, reed members 48,50 are not connected to coil devices 22,74, but rather are connected elsewhere in the electrical circuit as desired.

The above modification of mercury relay 10 including reed switch 44 can be further modified to include magnet 62 attached to the top portion of displacement plunger 18 and externally disposed adjacently to the top of cylindrical electrode 14 reed switch 54 having reed members 58, 60. The operation of this modification is similar to the one just described above, and includes reed switch 54 being either a normally-open or normally-closed switch. The operation of this modification is similar to mercury relay 52 illustrated in FIG. 5 and includes actuation of switches 44,54 by actuating coil device 22 with an impulse of short duration. Further, this modification of mercury relay 10 including switches 44 and 54 can be designed to operate in any one of the four types earlier described in relation to mercury relay 52 illustrated in FIG. 5.

Figure 7:
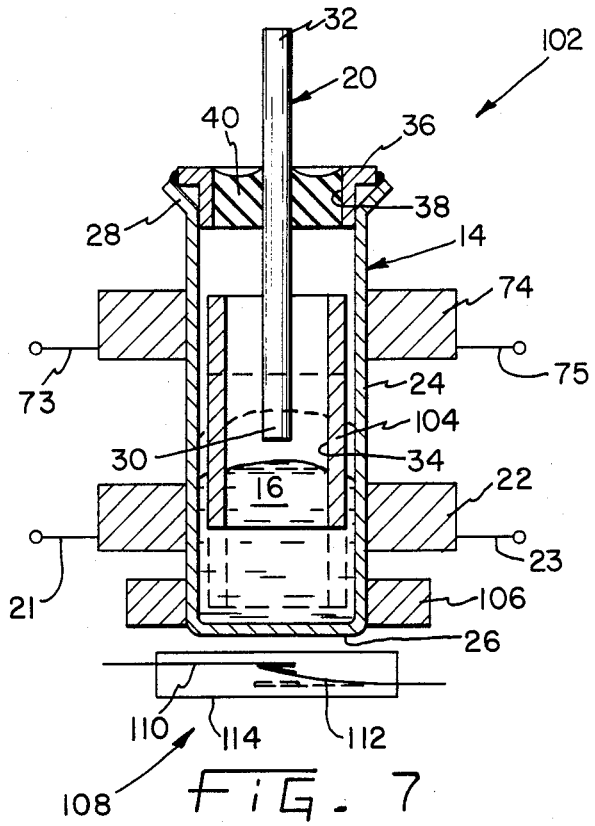
FIG. 7 is an elevational view in section of another embodiment of the present invention.

Referring now to FIG. 7, mercury relay 102 includes displacement plunger 104 movably disposed within cylindrical electrode 14 and permanent ring magnet 106 externally disposed and adjacent to the bottom portion of cylindrical electrode 14. Reed switch 108 includes reed members 110,112 housed in enclosure 114 and is externally disposed adjacently to the bottom portion of cylindrical electrode 14 and is actuated by magnet 106 when displacement plunger 104 is at its first position indicated in solid lines. Reed switch 108 can be a normally-open switch wherein reed member 112 is substantially rigid as indicated in dashed lines and reed member 110 is magnetically and resiliently held in spaced-apart relation from reed member 112 by magnet 106, and can be a normally-closed switch wherein reed member 110 is substantially rigid and reed member 112 is magnetically and resiliently held against reed member 110 by magnet 106. Upon energizing coil device 22, displacement plunger 104 is moved downwardly to a second position indicated in dashed lines to sufficiently alter or degrade the magnetic force field created by magnet 106 to deactuate switch 108. Displacement plunger 104 is made of a material having sufficiently low permeance thus to alter or degrade the magnetic field of magnet 106. Furthermore, upon deenergizing coil device 22, magnet 106 magnetically holds displacement plunger 104 at its second position. To return displacement 104 to its original first position indicated in solid lines, coil device 74 is energized to create an electromagnetic force to overcome the magnetic attraction between plunger 104 and magnet 106, thereby deactuating reed switch 108.

While this invention has been described as having preferred embodiments, it will be understood that it is capable of further modifications. This application is therefore intended to cover any variations, uses, or adaptations of the invention following the general principles thereof and including such departures from the present disclosure as come within known or customary practice in the art to which this invention pertains and fall within the limits of appended claims.

What is claimed is:

1. A liquid conductor relay, comprising:

a first electrode member having a top portion and a bottom portion, a liquid conductor contained in said first electrode member, a second electrode member received and secured in said first electrode member, a displacement plunger in said first electrode member and movable between a first position wherein said liquid conductor and said second electrode member are in spaced-apart relation and a second position wherein said displacement plunger is displaced downwardly in said liquid conductor to displace said liquid conductor upwardly in contact with said second electrode member, a coil means in proximity to said first electrode member for moving said displacement plunger from said first position to said second position when energized, said displacement plunger moving from said second position to said first position when said coil means is deenergized, a magnet means movable with said displacement plunger between said first and said second positions, and a magnetically-actuable switch means externally disposed of said first electrode member and in close proximity thereto, said magnetically-actuable switch means being actuated by said magnet means and said liquid conductor being in contact with said second electrode member when said coil means moves said displacement plunger and said magnet means from said first position to said second position.

2. The device of claim 1 wherein said magnet means is disposed on a bottom portion of said displacement plunger, and said switch means is adjacently disposed to said bottom portion of said first electrode member, said switch means being magnetically actuated by said magnet means and said liquid conductor being in contact with said second electrode member when said displacement plunger is at said second position.

3. The device of claim 2 wherein said switch means is a reed switch comprising a pair of electrically conductive reed members, said reed members being in spaced-apart relation when said displacement plunger and said magnet means are at said first position, one of said reed members being magnetically and resiliently held in electrical contact against the other said reed member by said magnet means when said displacement plunger and said magnet means are at said second position.

4. The device of claim 3 wherein said magnet means is provided by said displacement plunger being made of a ferro-ceramic magnetic material.

5. The device of claim 2 wherein said switch means is a reed switch comprising a pair of electrically conductive reed members, said reed members being in electrical contact with each other when said displacement plunger and said magnet means are at said first position, one of said reed members being magnetically and resiliently held in spaced-apart relation from the other said reed member by said magnet means when said displacement plunger and said magnet means are at said second position.

6. The device of claim 5 wherein said magnet means is provided by said displacement plunger being made of a ferro-ceramic magnetic material.

7. The device of claim 2 further comprising a second magnet means disposed on a top portion of said displacement plunger and a second magnetically-actuable switch means externally and adjacently disposed to said top portion of said first electrode member, said second magnetically-actuable switch means being magnetically actuated by said second magnet means.

8. The device of claim 7 wherein said first mentioned switch means is a first reed switch comprising a pair of electrically conductive reed members in spaced-apart relation when said displacement plunger and said first mentioned magnet means are at said first position, one of said reed members being magnetically and resiliently held against the other said reed member by said first mentioned magnet means when said displacement plunger and said first mentioned magnet means are at said second position, and wherein second switch means is a second reed switch comprising a pair of electrically conductive reed members, one of said reed members being magnetically and resiliently held in spaced-apart relation from the other of said reed member by said second magnet means when said displacement plunger and said second magnet means are at said first position, said one reed member being in electrical contact with said other reed member when said displacement plunger and said second magnet means are at said second position.

9. The device of claim 7 wherein said first mentioned switch means is a first reed switch comprising a pair of electrically conductive reed members being in spaced-apart relation when said displacement plunger and said first mentioned magnet means are at said first position, one of said reed members being magnetically and resiliently held in electrical contact against the other said reed member by said first mentioned magnet means when said displacement plunger and said first mentioned magnet means are at said second position, and wherein said second switch means is a second reed switch comprising a pair of electrically conductive reed members, one of said reed members being magnetically and resilently held in electrical contact against the other said reed member by said second magnetic means when said displacement plunger and said second magnetic means are at said first position, said one reed member being spaced-apart from said other reed member when said displacement plunger and said second magnet means are at said second position.

10. The device of claim 7 wherein said first mentioned switch means is a first reed switch comprising a pair of electrically conductive reed members, said reed members being in electrical contact with each other when said displacement plunger and said first mentioned magnet means are at said first position, one of said reed members being magnetically and resiliently held in spaced-apart relation from the other said reed member by said first mentioned magnet means when said displacement plunger and said first mentioned magnet means are at said second position, and wherein said second switch means is a second reed switch comprising a pair of electrically conductive reed members, one of said reed members being magnetically and resiliently held in spaced-apart relation from the other said reed member by said second magnet means when said displacement plunger and said second magnet means are at said first position, said one reed member being in electrical contact with said other reed member when said displacement plunger and said second magnet means are at said second position.

11. The device of claim 7 wherein said first mentioned switch means is a first reed switch comprising a pair of electrically conductive reed members being in electrical contact with each other when said displacement plunger and said first mentioned magnet means are at said first position, one of said reed members being magnetically and resiliently held in spaced-apart relation from the other said reed member by said first mentioned magnet means when said displacement plunger and said first mentioned magnet means are at said second position, and wherein said second switch means is a second reed switch comprising a pair of electrically conductive reed members, one of said reed members being magnetically and resiliently held in electrical contact against the other said reed member by said second magnet means when said displacement plunger and said second magnet means are at said first position, said one reed member being spaced-apart from said other reed member when said displacement plunger and said second magnet means are at said second position.

12. The device of claim 7 wherein said first mentioned magnet means and said second magnet means are provided by said displacement plunger being made of a ferro-ceramic magnetic material.

13. The device of claim 2 further comprising a holding means made of a ferromagnetic material and secured to said bottom portion of said first electrode member, said magnet means being magnetically held at said second position by its magnetic attraction to said holding means after said coil means is deenergized, thereby maintaining said displacement plunger at said second position to continue actuation of said switch means and electrical contact between said liquid conductor and said second electrode member.

14. The device of claim 13 further comprising means in proximity to said first electrode member for overcoming the magnetic attraction between said magnet means and said holding means for the separation thereof when said displacement plunger is at said second position, said displacement plunger moving from said second position to said first position when said coil means is deenergized and when said overcoming means separates said magnet means from said holding means.

15. The device of claim 14 wherein said overcoming means is a second coil means in proximity to said first electrode member, said second coil means when energized overcoming the magnetic attraction between said magnet means and said holding means to allow said displacement plunger to move from said second position to said first position.

16. The device of claim 14 wherein said overcoming means is a permanent magnet device movable between a nonattractive position relative to said magnet means at said second position and an attractive position relative to said magnet means at said second position, said permanent magnet device at said attractive position overcoming the magnetic attraction between said magnet means and said holding means to allow said displacement plunger to move from said second position to said first position when said coil means is deenergized.

17. The device of claim 16 further comprising a bias means operatively connected to said permanent magnet device for biasing said permanent magnet device to said nonattractive position.

18. The device of claim 17 wherein said bias means is a spring connected to said permanent magnet device, said permanent magnet device being manually movable from said nonattractive position to said attractive position.

19. The device of claim 1 wherein said magnet means is disposed on a top portion of said displacement plunger, and said switch means is adjacently disposed to said top portion of said first electrode member, said switch means being magnetically actuated by said magnet means and said liquid conductor being in contact with said second electrode member when said displacement plunger is at said second position.

20. The device of claim 19 wherein said switch means is a reed switch comprising a pair of electrically conductive reed members, one of said reed members being magnetically and resiliently held in spaced-apart relation from the other said reed member by said magnet means when said displacement plunger and said magnet means are at said first position, said one reed member being in electrical contact with said other reed member when said displacement plunger and said magnet means are at said second position.

21. The device of claim 19 wherein said switch means is a reed switch comprising a pair of electrically conductive reed members, one of said reed members being magnetically and resilently held in electrical contact against the other said reed member by said magnet means when said displacement plunger and said magnet means are at said first position, said one reed member being in spaced-apart relation from said other reed member when said displacement plunger and said magnet means are at said second position.

22. A liquid conductor relay, comprising:

a first electrode member having a top portion and a bottom portion.

a liquid conductor contained in said first electrode member, a second electrode member received and secured in said first electrode member, a displacement plunger in said first electrode member and movable between a first position wherein said liquid conductor and said second electrode member are in spaced-apart relation and a second position wherein said displacement plunger is displaced downwardly in said liquid conductor to displace said liquid conductor upwardly in contact with said second electrode member, a coil means in proximity to said first electrode member for moving said displacement plunger from said first position to said second position when energized, one of a magnet means and a ferromagnetic holding means disposed on a bottom portion of said displacement plunger and movable with said displacement plunger between said first and said second positions, the other of said magnet means and said ferromagnetic holding means secured to said bottom portion of said first electrode member, the magnetic attraction between said magnet means and said ferromagnetic holding means being sufficient to hold said displacement plunger at said second position when said coil means is deenergized, thereby maintaining electrical contact between said liquid conductor and said second electrode member.

23. The device of claim 22 wherein said holding means is on said bottom portion of said displacement plunger, and said magnet means is secured to said bottom portion of said first electrode member.

24. The device of claim 22 wherein said magnet means is on said bottom portion of said displacement plunger, and said holding means is secured to said bottom portion of said first electrode member.

25. The device of claim 22 further comprising means in proximity to said first electrode member for overcoming the magnetic attraction between said magnet means and said holding means when said displacement plunger is at said second position, said displacement plunger moving from said second position to said first position when said coil means is deenergized and said magnet means and said holding means are separated.

26. The device of claim 25 wherein said magnet means is on said bottom portion of said displacement plunger, and said holding means is secured to said bottom portion of said first electrode member.

27. The device of claim 26 wherein said overcoming means is a second coil means in proximity to said first electrode member, said second coil means when energized overcoming the magnetic attraction between said magnet means and said holding means to allow said displacement plunger to move from said second position to said first position when said first mentioned coil means is deenergized.

28. The device of claim 26 wherein said overcoming means is a permanent magnet device movable between a nonattractive position relative to said magnet means at said second position and an attractive position relative to said magnet means at said second position, said permanent magnet device when at said attractive position overcoming the magnetic attraction between said magnet means and said holding means to allow said displacement plunger to move from said second position to said first position when said coil means is deenergized, and further comprising a bias means connected to said permanent magnet device for biasing said permanent magnet device to said nonattractive position.

29. The device of claim 26 further comprising a magnetically-actuable switch means externally disposed adjacently to said bottom portion of said first electrode member, said magnetically-actuable switch means being actuated by said magnet means when said coil means moves said displacement plunger from said first position to said second position.

30. The device of claim 29 wherein said switch means is a reed switch comprising a pair of electrically conductive reed members being in spaced-apart relation when said displacement plunger is at said first position, one of said reed members being magnetically and resiliently held in electrical contact against the other said reed member by said magnet means when said displacement plunger is at said second position.

31. The device of claim 29 wherein said switch means is a reed switch comprising a pair of electrically conductive reed members being in electrical contact with each other when said displacement plunger is at said first position, one of said reed members being magnetically and resiliently held in spaced-apart relation from the other said reed member by said magnet means when said displacement plunger is at second position.

32. The device of claim 29 further comprising a second magnet means disposed on a top portion of said displacement plunger and a second magnetically-actuable switch means externally disposed adjacently to said top portion of said first electrode member.

33. The device of claim 32 wherein said first mentioned switch means is a first reed switch comprising a pair of electrically conductive reed members being in spaced-apart relation when said displacement plunger is at said first position, one of said reed members being magnetically and resiliently held against the other said reed member by said first mentioned magnet means when said displacement plunger is at said second position, and wherein said second switch means is a second reed switch comprising a pair of electrically conductive reed members, one of said reed members being magnetically and resiliently held in spaced-apart relation from the other said reed member by said second magnet means when said displacement plunger is at said first position, said one reed member being in electrical contact with said other reed member when said displacement plunger and said second magnet means are at second position.

34. The device of claim 32 wherein said first mentioned switch means is a first reed switch comprising a pair of electrically conductive reed members being in spaced-apart relation when said displacement plunger is at said first position, one of said reed members being magnetically and resiliently held in electrical contact against the other said reed member by said first mentioned magnet means when said displacement plunger is at said second position, and wherein said second switch means is a second reed switch comprising a pair of electrically conductive reed members, one of said reed members being magnetically and resiliently held in electrical contact against the other said reed member by said second magnet means when said displacement plunger is at said first position, said one reed member being spaced-apart from said other reed member when said displacement plunger is at said second position.

35. The device of claim 32 wherein said first mentioned switch means is a first reed switch comprising a pair of electrically conductive reed members being in electrical contact with each other when said displacement plunger is at said first position, one of said reed members being magnetically and resiliently held in spaced-apart relation from the other said reed member by said first mentioned magnet means when said displacement plunger is at said second position, and wherein said second switch means is a second reed switch comprising a pair of electrically conductive reed members, one of said reed members being magnetically and resiliently held in spaced-apart relation from the other said reed member by said second magnet means when said displacement plunger is at said first position, said one reed member being in electrical contact with said other reed member when said displacement plunger is at said second position.

36. The device of claim 32 wherein said first mentioned switch means is a first reed switch comprising a pair of electrically conductive reed members being in electrical contact with each other when said displacement plunger is at said first position, one of said reed members being magnetically and resiliently held in spaced-apart relation from the other said reed member by said first mentioned magnet means when said displacement plunger is at said second position, and wherein said second switch means is a second reed switch comprising a pair of electrically conductive reed members, one of said reed members being magnetically and resiliently held in electrical contact against the other said reed member by said second magnet means when said displacement plunger is at said first position, said one reed member being spaced-apart from said other reed member when said displacement plunger is at said second position.

37. The device of claim 26 wherein said overcoming means is a second coil means in proximity to said first electrode member, said second coil means when energized overcoming the magnetic attraction between said magnet means and said holding means, and further comprising a magnetically-actuable reed switch externally disposed adjacently to said bottom portion of said first electrode member, said magnetically-actuable reed switch comprising three electrically conductive reed members, a first one and a second one of said reed members being in electrical contact with each other when said displacement plunger is at said first position, and a third one of said reed members and said second reed member being in spaced-apart relation when said displacement plunger is at said first position, said first reed member being magnetically and resiliently held in spaced-apart relation from said second reed member by said magnet means when said displacement plunger is at said second position, and said third reed member being magnetically and resiliently held in electrical contact against said second reed member by said magnet means when said displacement plunger is at said second position.

38. The device of claim 37 wherein said second reed member is adapted to be electrically connected to a source of electrical energy, said first reed member is electrically connected to said first mentioned coil means, and said third reed member is electrically connected to said second coil means, whereby when said displacement plunger is at said first position and electrical energy is supplied to said second reed member, said second reed member and said first reed member supply electrical energy to said coil means for the energization thereof, thereby moving said displacement plunger from said first position to said second position to be magnetically held thereat by said magnet means and said holding means, and whereby upon supplying electrical energy to said second reed member, said second reed member and said third reed member energize said second coil means, thereby moving said displacement plunger from said first position to said second position.

39. A liquid conductor relay, comprising:

a first electrode member having a top portion and a bottom portion, a liquid conductor contained in said first electrode member, a second electrode member received and secured in said first electrode member, a displacement plunger in said first electrode member and movable between a first position wherein said liquid conductor and said second electrode member are in spaced-apart relation and a second position wherein said displacement plunger is displaced downwardly in said liquid conductor to displace said liquid conductor upwardly in contact with said second electrode member, a first coil means in proximity to said first electrode member for moving said displacement plunger from said first position to said second position when energized, a magnet means externally disposed adjacently to said bottom portion of said first electrode member, said magnet means magnetically holding said displacement plunger at said second position when said first coil means is deenergized, a magnetically-actuable switch means externally disposed of said first electrode member and in close proximity to said magnet means, said magnetically-actuable switch means being actuated by said magnet means when said displacement plunger is at said first position, and a second coil means in proximity to said first electrode member for overcoming the magnetic attraction between said magnet means and said displacement plunger at said second position, said displacement plunger moving from said first position to said second position when said second coil means is energized, said displacement plunger being made of a material having sufficiently low permeance to substantially decrease the magnetic field strength of said magnet means when at said second position to thereby deactuate said switch means.

40. The device of claim 39 wherein said switch means is a reed switch comprising a pair of electrically conductive reed members being in spaced-apart relation when said displacement plunger is at said first position, one of said reed members being magnetically and resiliently held in electrical contact against the other said reed member by said magnet means when said displacement plunger is at said second position.

41. The device of claim 39 wherein said switch means is a reed switch comprising a pair of electrically conductive reed members, said reed members being in electrical contact with each other when said displacement plunger is at said first position, one of said reed members being magnetically and resiliently held in spaced-apart relation from the other said reed member by said magnet means when said displacement plunger is at said second position.

* * * * *